US005348628A

United States Patent [19]

Ishibashi et al.

[11] Patent Number: 5,348,628

[45] Date of Patent: Sep. 20, 1994

[54] METHOD OF TREATING SALT BATH LIQUID

[75] Inventors: Tadaya Ishibashi, Suita; Masanori Sasaki, Okazaki; Hideto Obara, Uji; Hiroshi Kano, Uji; Shintaro Yamashita, Uji, all of Japan

[73] Assignee: Unitika Ltd., Hyogo, Japan

[21] Appl. No.: 812,627

[22] Filed: Dec. 23, 1991

[30] Foreign Application Priority Data

Apr. 2, 1991 [JP] Japan ..... 3-68649
May 31, 1991 [JP] Japan ..... 3-128069

[51] Int. Cl.[5] ..... C23G 1/19; C02F 1/469; C02F 9/00

[52] U.S. Cl. ..... 204/153; 204/98; 204/151; 204/152; 134/2; 134/10; 134/26; 134/95.3

[58] Field of Search ..... 204/153, 152, 151, 98; 134/2, 10, 26, 95.3

[56] References Cited

U.S. PATENT DOCUMENTS

| | | | |
|---|---|---|---|
| 3,260,619 | 7/1966 | Shoemaker et al. | 134/3 |
| 4,017,343 | 4/1977 | Haas | 134/10 |
| 4,039,349 | 8/1977 | Kwasnoski et al. | 134/10 |
| 4,319,930 | 3/1982 | Yano et al. | 134/10 |
| 4,654,089 | 3/1987 | Singelyn et al. | 134/26 |

*Primary Examiner*—John Niebling
*Assistant Examiner*—John S. Starsiak, Jr.
*Attorney, Agent, or Firm*—Joseph W. Farley

[57] ABSTRACT

The present invention relates to the method of treating the salt bath liquid. In the surface treatment of the steel material by the use of the high-temperature salt bath mainly comprising sodium hydroxide and sodium nitrate, the salt ingredients contained in the washings generated are separated to be recovered and the metal salts contained are separated in the form of the insoluble salts. The salts contained in the nitrate radical-containing liquid system are recovered as the free acids again, the alkalies being recovered, and the reagents contained in the overflow from the salt-washing tank being recovered. The anode chamber liquid generated in the recoverying operation of the reagents is returned to the washing tank again to increase the concentration of the salts. The anode chamber liquid is poured into the pickling tank to reduce the oxidizing soluble metal salts contained in the washings by iron within the pickling tank, whereby the oxidizing soluble metal salts are insolubilized. The mixture liquid of the overflows from the respective tanks and the washing water for removing the foreign matters in the salt bath is mixed with the nitric acid-containing liquid for pickling the steel material and then sodium hydroxide is supplied to alkalize. Thus, the dissolved metal compounds in the liquids, which have been used for the treatment, are separated into the insoluble solid metal hydroxides and the liquid of the soluble salts without mixing the insoluble alkalies.

3 Claims, 5 Drawing Sheets

METHOD OF TREATING SALT BATH LIQUID

FIELD OF THE INVENTION

The present invention relates to a method of treating a salt bath liquid, in particular to a method of treating a salt bath liquid, in which free alkaline reagents and neutral salts coexist in high concentrations, and a method of treating a salt bath liquid for treating a discharged liquid generated in a chilling treatment of stainless steels subjected to a treatment with a salt bath, a discharged liquid generated in a washing of salts stuck to sediments accumulated in a salt bath tank for steel materials and the like.

BACKGROUND OF THE INVENTION

For example, in order to destruct a surface film of steel materials represented by stainless steels coated with a remarkably strong oxidized film, whereby removing scale ingredients, it has been proposed to immerse them in a high-temperature composite salt bath. As for a method of treating a solution generated in this immersing treatment, a method, in which nitrate radicals causing a supernutrition and strongly poisonous oxidizing chromium salts are discharged in high concentrations and a system is maintained under the strongly acidic condition to separate these chromium salts followed by adding a reagent having a strong reducing power to turn said system basic again, whereby separating metallic ingredients, has been adopted. However, expensive reagents contained have not been recovered and great expenses have been spent in a removal of said metallic ingredients.

Of salt radicals contained in a discharged water, in the case where a method of acting them upon outside compounds to turn them into insoluble substances, whereby separating them out of the system, has been known, no problem occurs but in general it is remarkably difficult to find a method of insolubilizing them.

Accordingly, if said salt radicals can be easily separated from a discharged system or a separation in the form of solution is easy and an accuracy of separation is high, there is the possibility that it is received in remarkably wide fields also in respect of environmental problems. However, no practical art has been discovered.

According to the known art, in order to insolubilize dissolved metallic ions under the condition that a considerable concentration of soluble metal salt coexists in the presence of high concentration of free alkali, at first a large quantity of acid has been added to neutralize alkaline ingredients and additionally a system has been acidified followed by adding a strong reducing reagent on the market to reduce an ionic valence, whereby regulating the pH which has been carried out as the general method of insolubilizing said metal salts.

It has been disclosed in Japanese Patent Application Laid-Open No. Hei 2-145786 that free acids in a pickling bath are recovered by the use of a diffusion dialysis membrane while a reducing power of ferrous ion ingredients remaining in a solution of metal salt ingredients, from which generated free fractions have been removed, is utilized.

However, a method of effectively removing soluble metal salts containing a large quantity of nitrate radicals discharged from a salt-treating process has not been disclosed in Japanese Patent Application Laid-Open No. Hei 2-145786.

A high-temperature salt bath is obtained by melting solid substances at high temperatures. A surface treatment of a steel material is carried out by immersing said steel material in this salt bath and process products are carried out together with the steel material. Said products are washed with a large quantity of water to be dissolved in washings, whereby being removed.

As to a composition of this salt bath, sodium hydroxide and sodium nitrate are used in a ratio of 6 to 7:4 to 3 in equivalent. That is to say, sodium hydroxide is dominant. In addition, there is a tendency that a quantity of sodium hydroxide in equivalent is larger than the total quantity of acid radicals in equivalent used in the process, that is a discharged water from a factory is considerably alkaline. Accordingly, there has been a general tendency that acids must be purchased from outside in order to neutralize said discharged water from a factory.

An overflown water, which has been subjected to this washing treatment, contains not only dissolved expensive reagents but also chromium ions and manganese ions oxidized to be dissolved from the treated steel material in a high concentration even within a strong alkaline range. In order to remove these ingredients together with insoluble ingredients, at first a large quantity of coexisting alkaline ingredient is neutralized with acids on the market and then strong reducing reagents on the market are additionally added with maintaining an acidity. Thus, an operation requiring great expenses, in which a reducing atmosphere reducing ionic valences of metals is generated and metallic ions are turned to be alkaline again to insolubilize general metallic ions and then the insoluble general metallic ions must be separated from a solution, must be adopted.

This operation is sufficiently analyzed with the following problems:

A) A problem occurs in that a large quantity of expensive sodium hydroxide to be turned into valueless salts having a reduced utility value. An effective recoverying method should be proposed.

B) Not only coexisting nitrates are difficult to be singly separated when mixed in the discharging system but also they contain a large quantity of nitrogen radical causing a supernutrition becoming an environmental problem. Accordingly, their quantity discharged is regulated in some districts even though they are not treated as poisonous substances. However, no effective removal effect has not been expected even though great expenses are spent.

However, nitrate radicals are expensive salts but it is expected that they can be reused as nitric acid used in the process if the acid radicals can be separated. If an ion electrolytic dissociating operation is adopted in this operation, it is expected that not only the metallic ingredients accumulated in the acidic bath can be removed but also sodium ions, which have acted upon the nitrate radicals, can be removed.

C) In addition, this liquid contains a large quantity of poisonous oxidized salt of chromium and manganese and their removal is strictly regulated in view of the pollution control and thus it is required to completely remove it. It is said acids purchased from outside for neutralizing said coexisting alkalies that spend the greatest expenses in the insolubilizing operation after the reduction. If these expenses are reduced, not only the removal of the free alkaline ingredients described in said item A) but also a reduction of expenses can be achieved.

The next problem consists in that said reducing operation of the metallic ions turned to maintain their dissolved condition even in an alkaline atmosphere is simplified. This reducing operation is achieved by finding out an atmosphere depriving electrons from the side of the other party when ferrous ions are oxidized to be turned into ferric ions and carrying out a treatment for producing that condition to reduce said ionic valences of the soluble salts in an acidic atmosphere in which said ferrous ions coexists.

The atmosphere meeting this condition is set up depending upon conditions within a pickling tank arranged in succession to the producing line of the same one steel material. These conditions consist in that free acid radicals are contained in a quantity of 0.7 to 1.0 equivalent, a strong acidity being always maintained, a liquid having a temperature of 40° to 60° which is required for a reaction, and a large quantity of ferrous ions required as a reducing agent being contained. A pickling bath has a composition preferably containing suitable quantities of ferrous ions and ferric ions and this composition is effective for enhancing a pickling effect of the steel material to be treated. If such the environment can be utilized well, it is not required to purchase the expensive reducing agent from outside as in the prior art and it is not required to increase a quantity of sludge for the reducing treatment.

In addition, it has been found that the reducing operation from hexavalent chromium ions to trivalent chromium ions with the ferrous ions is carried out in the same one bath as in the descaling of the stainless steel material, so that scales remaining on a surface of the stainless steel material are removed and at the same time reduced chromium is stuck to an activated metallic surface to change scientific characteristics of said metallic surface.

On the other hand, reagents composing the bath carried out from the salt bath for the salt-treatment of the stainless steel are expensive and can not be turned into insoluble salts even by the neutralizing treatment and thus they become nitrate radicals as a nitrogen source causing a supernutrition when contained in the discharged water, so that their removal has been called in question.

Sodium nitrate mainly contained in these baths are soluble. Accordingly, in order to take out it from the system, a concentrating operation cannot but being used. In addition, even though it is concentrated, it can not be reused unless it is dehydrated in respect of its real application.

Furthermore, said reagents carried out from this salt bath include chromium molecules, which are one of the ingredients composing the stainless steel material to be treated, but these chromium molecules are turned from $Cr^{3+}$into $Cr^{6+}$because a treating temperature is high. This $Cr^{6+}$is soluble to water and strongly poisonous. Accordingly, its sure disposition as the pollution control is required but its control is difficult and thus a problem in view of disposition of wastes occurs.

Consequently, according to the prior art, $Cr^{6+}$is reduced to $Cr^{3+}$in the presence of the reducing agent and the resulting $Cr^{3+}$is removed by the cohering treatment. However, nitrate radicals have not been removed from the water system.

It has been proposed also that a ferrous salt on the market is used for the aimed treatment as the reducing agent of hexavalent chromium.

It has been disclosed in Japanese Patent Application Laid-Open No. Hei 2-145786 that free acids in a picking bath are recovered by the use of a diffusion dialysis membrane while a discharged liquid mainly containing metallic ingredients generated is utilized as a reducing-neutralizing agent. It has never been, however, disclosed in Japanese Patent Application Laid-Open No. Hei 2-145786 that nitrate radicals contained in the liquid, which has been subjected to the chilling treatment, are concentrated to separatedly recoverfree nitric acid and sodium hydroxide, whereby reutilizing them to reduce a quantity of reagents contained in the discharged water.

The reagents used in the salt bath are not only expensive but also has the characteristics that it is difficult to separate them from the solution followed by concentrating.

On the other hand, although an aged nitric acid family pickling liquid has been in general singly neutralized to be discharged, a part of iron contained in it effectively acts for the reduction of hexavalent chromium ions. Accordingly, said quantity of said reagents to be used can be reduced by mixing these liquids.

DESCRIPTION OF THE INVENTION

So, the present invention is applied to a treatment of a liquid taken out of a metal-washing bath tank and the like in a treatment, in which a steel material is immersed in an alkaline bath having a high temperature to change a surface condition of said steel material, to recover reagents in high purity and change a compositional ratio of coexisting salts. And, it is an object of the present invention to provide a treating process with special treatment effects, which have never been exhibited in the prior arts, that the characteristics of coexisting substances in other treatment tanks are effectively utilized to remarkably save resources and a steel material, which has been subjected to a surface treatment, is remarkably improved in corrosion resistance added.

In addition, according to the present invention, reagents having a reducing power is selectively extracted from other places, where the same operation is carried out, in a factory to effectively act said reagents upon poisonous and soluble chromium compounds contained in the treated liquid. That is to say, it is an object of the present invention to solve the above described problems by recoverying said salts contained in a nitrate radical-containing liquid system in the form of free acid again and using it as an alkaline reagent in other places in the process, whereby effectively utilizing resources.

In order to solve the above described matters to be investigated, the following points are required.

a) A method capable of efficiently removing free sodium hydroxide from a liquid overflown from a washing tank of said steel material, which has been subjected to said treatment with the salt bath, is found out and a method of reusing separated sodium hydroxide without carrying out a neutralizing operation of an excess of alkaline ingredient with acids supplied from outside.

b) It is made possible that sodium cations of sodium nitrate contained in the liquid, from which sodium hydroxide has been removed, are removed.

c) Conditions under which metal salts contained in said liquid, from which free sodium hydroxide has been removed, are reduced are found out and metallic cations accumulated in that system are removed.

Consequently, according to the present invention, a washing tank is partitioned into a plurality of tanks to filter liquids within the respective partitioned tanks by means of a filter using a filter medium resisting to high temperatures and concentrated alkalies, whereby removing floating matters apt to be accumulated in said washing tank. And, the liquid, from which said floating matters have been removed, is spouted from a first nozzle to wash the steel material. In addition, a mixture fluid of a fresh washing water from outside of the washing tank and a pressurized air is spouted toward the steel material from a second nozzle in the washing tank and said second nozzle is vibrated sideways. An overflow, which has been used for the washing in the washing tank, is flown out from a side, where the steel material heated in the salt bath tank is carried in the washing tank, and said fresh washing water is supplied from a side, where the steel material is carried out from the washing tank, to wash the steel material in a counterflow multi-stage method. The washing liquid sprayed onto the steel material is evaporated by a heat accumulated in the steel material carried in the washing tank but the liquid, from which sodium hydroxide has been removed, generated when salt ingredients contained in said overflow discharged outside of the washing tank are recovered is returned to the washing tank again to be reused as the washing water in order to replenish a quantity of the liquid concentratedly reduced by this evaporation.

In addition, according to the present invention, an electrolyzer, in which dissolved salts are forcibly dissociated and an ion exchange membrane effectively utilizing charging characteristics of dissociated ions and selectively transmitting merely cations during an electrophoresis of ions in a direct electric field is used as a partition diaphragm, is used. Thus, anions can be separated from cations and ingredients charged oppositely to each other are removed among themselves in the solution within the respective partition chambers to be able to heighten a purity of said ingredients within the respective partition chambers and remove unnecessary ingredients.

This treatment can be adopted similarly also in the case where a belt-shaped steel material is continuously supplied, the case where a block of rod-shaped wire materials bundled is subjected to a batch-type immersing treatment, the case where articles to be treated are small and they are treated in a bascket, and the like.

Consequently, according to the present invention, an effect meeting said object can be exhibited by combining an operating method of the electrolyzer matching to a required operation. In other words, the present invention separates singly free alkalies remaining in the solution from the solution containing coexisting salts in a high partition coefficient. And, at the same time, when also the remaining coexisting salts are by-decomposed again into free acids containing anionic radicals and alkalies containing cations to separatedly recover them in the subsequent process, the soluble metal salts dissolved and remained in a high concentration even under the strongly high alkaline condition are insolubilized.

Furthermore, according to the present invention, when the salt bath composed of a nitrate or sodium hydroxide is used to subject the steel material to a surface treatment, reagents contained in the overflow generated by immersing the steel material, which has been immersed in the high-temperature molten salts followed by taking out, in water to be cooled, the overflow generated by neutralizing said alkalies stuck to the steel material subjected to said cooling treatment and washings generated during the washing for removing a salt bath composite stuck to slags accumulated in a bottom of the salt bath and then taken out are recovered. To this end, chromium compounds, which have been formed when chromium composing the steel material to be treated is turned into hexavalent soluble salts in the salt bath, dissolved in said mixture liquid of the above described respective solutions are reduced to be turned into insoluble hydroxide. A part of an acidic liquid containing metallic ions dissolving in a bath containing at least nitric acid for pickling the steel material and remaining free acids is poured in the liquid, which has been subjected to the neutralizing operation, as a reducing agent for the mixture liquid. And, said hexavalent salts contained in said liquid to be treated are reduced to trivalent salts provided that this high-temperature and acidic condition of the reducing reaction is maintained followed by alkalizing with sodium hydroxide. Thereupon, said dissolved metal compounds are separated into insoluble solid metal hydroxides and a liquid of soluble salts, such as soluble sodium nitrate and sodium hydroxide, without mixing insoluble alkalies.

The composition of the salt bath has the following characteristics:

(A) The salt solution is mainly composed of sodium hydroxide and sodium nitrate, these reagents existing in the form of the salts of dissolved metals, and metallic ions being contained in a high concentration.

(B) A temperature within the salt bath is high to an extent of 400° to 600° C., so that chromium in the dissolved chromium compounds is oxidized to hexavalent to be turned into stable compounds and dissolved.

(C) Also other metals are dissolved in the form of salts and these compounds are brought into contact with water for the chilling treatment to be dissolved in the liquid system and transferred to the drainage side. However, although alkaline chromium oxidized to hexavalent is soluble, others are insoluble and a dispersion is separated into a soluble neutral salt, that is sodium nitrate, (a); an alkali, that is sodium hydroxide, (b); and dispersed corpuscles, that is metal oxides.hydroxides.

(D) On the other hand, in general a factory aiming at the surface treatment of stainless steels has a treatment bath using a nitric acid bath at the same time and said treatment bath loses its function with the dissolution of metals therein, so that the treatment bath must be discharged. However, the treatment bath contains bivalent iron and in particular iron oxidized with nitric acid has a strong reducing power. This reducing power has a function of efficiently reducing hexavalent chromium to cut down a toxity and further separating chromium in the form of hydroxide.

In addition, also the drainage contained in an acid bath utilized for an electrolytic separating operation using other nitric acid baths and washings effectively acts.

Furthermore, since free acids remain in the treatment bath in which the reducing treatment has been over, metallicions exist in the treatment bath. Accordingly, said metallic ions can be separated in the form of insoluble metal hydroxides by further adding alkalies.

At this time, it is important to select said alkalies to be used.

According to the present invention, the possibility that the dissolved salts are separated into free acids and alkalies by the electrolytic separating operation is utilized. An excess of alkalies added forms insoluble compounds in the operation of forming metal hydroxides by the use of alkalies. This means an increase of impurities as seen from the side of the separated metal hydroxides. However, this problem can be avoided by reusing sodium hydroxide which does not greatly hinder the reusability of the separated metal hydroxides.

Thus, a large quantity of valuable metal compounds contained can be reused and furthermore expensive reagents required for the reducing operation and the separating operation are produced in the treatment process, so that a reduction in cost can be achieved.

Detailly speaking, at first hexavalent chromium of the above described soluble metal salt, that is sodium chromate, is made unpoisonous and insolubilized by the use of the discharged acidic bath shown in the above described item (D) and additionally the salts dissolved in the solution are separated to be recovered.

An apparatus comprising cylindrical anode and cathode standing face to face and at least one partition diaphragm made of an ion exchange membrane having an ion selective separating function and an oxidation resistance and a low electric resistance disposed between both electrodes is suitable for the process of separating the free acid radicals and alkali radicals of the dissolved salts. A diaphragm chamber close to the side of an anode chamber isolated by this partition diaphragm is supplied with an object solution of alkalies. In addition, sodium hydroxide, which has been electrophoretically separated from said anode chamber, is accumulated in an opposite cathode chamber.

Since sodium hydroxide is accumulated in said cathode chamber in the above described manner, free nitric acid is formed on the side of the anode chamber. In addition, in the case where a concentration of formed nitric acid is low and a problem occurs in its reuse, this problem can be avoided by arranging so that a partition diaphragm chamber in front of the partition diaphragm in front of the anode chamber may be supplied with a sample and nitric acid may be diffused into the anode chamber.

In this case, a current efficiency of the electrolytic separating operation is high and the treatment can be carried out at the same cost as in the case where the respective reagents are purchased, so that a great saving of resources can be achieved also on the economic side.

As above described, according to the present invention, in the treatment of the steel material, such as stainless steels, in the high-temperature salt bath containing oxidizable salts, salts contained in the liquid discharged from the washing tank, which is the following treating apparatus, can be recovered in the form of the single free salts again. In addition, the metal salts, which have been contained in this liquid, being strongly poisonous, and being unable to be sedimented and separated unless the reducing treatment is adopted, can be removed by reducing by the use of iron salts accumulated in the pickling bath in the same one line and using an electrolyzer provided aiming at the removal of the metal salts accumulated in this pickling bath. Consequently, according to the present invention, the consumption of reagents can be remarkably reduced as compared with the known methods and furthermore a nitrate radical incapable of being insolubilized can be prevented from being discharged outside of the system.

Besides, according to the present invention, the concentrated solution of sodium nitrate generated from the treatment of the stainless steels with salts can be recovered to be used as the acid bath composite again without being discharged outside of the system. In addition, means for converting hexavalent chromium, which is inevitably generated in the high-temperature treatment with salts, to trivalent chromium and the reagents for separating the insoluble substances from the liquid system can be obtained from the same drainage. Thus, also the reagents contained in that drainage can be recovered at the same time. Accordingly, the saving of reagents and resources, the recovery of the valuable reagents and the environmental cleanup operation due to the reduction of soluble nitrogen sources can be achieved together.

DESCRIPTION OF THE PREFERRED EMBODIMENTS

Figure 1:
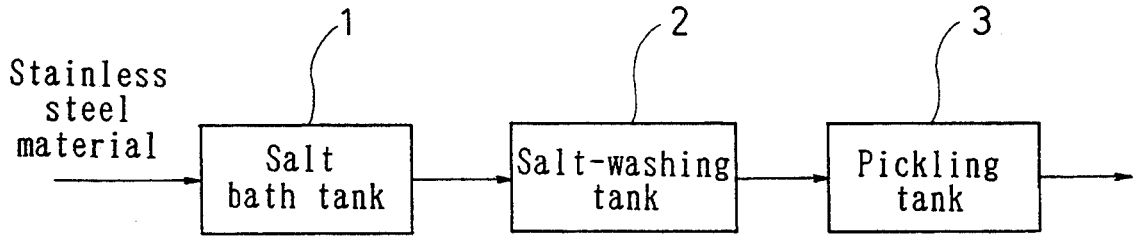
FIG. 1 is a diagram showing an arrangement of treating tanks in one preferred embodiment of the present invention.

1) In a salt bath tank 1 shown in FIG. 1, steel materials, such as belt-shaped stainless steels, are continuously immersed to be treated. Then, said steel materials are supplied in the salt-washing tank 2 to dissolve salts stuck to the steel materials in a washing liquid supplied from outside by means of a multi-stage washing mechanism of the salt-washing tank 2 and thus said salts are removed. Subsequently, the steel materials are supplied in a pickling tank 3.

2) A high-temperature salt bath comprises solid sodium hydroxide and solid sodium nitrate in a ratio of 65:35 by weight. Said salt bath is heated to be molten with maintaining a temperature of 400° to 600° C., whereby being used for an aimed treatment. A quantity of sodium hydroxide and sodium nitrate reduced by sticking to the steel materials to be carried out of a salt bath tank with the lapse of time is replenished with solid salts mixed at the above described compositional ratio.

Figure 2:
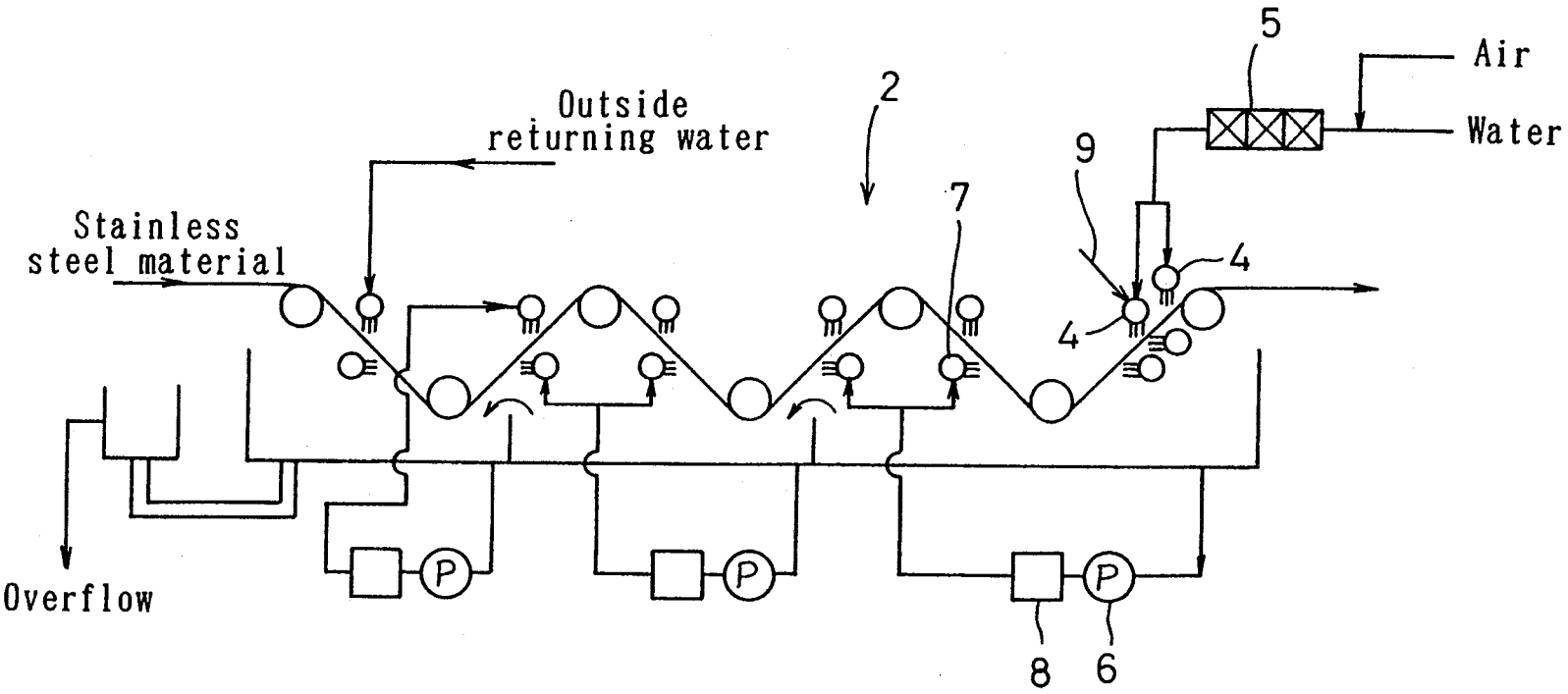
FIG. 2 is a detail diagram showing a construction of a salt-washing tank shown in FIG. 1.

3) FIG. 2 shows a multi-stage washing mechanism of the washing tank 2.

The steel materials, for example belt-shaped steels having a width of 600 mm and a thickness of 1 mm, are immersed in the respective treating tanks 1, 2, 3 at a speed of 6 m/min to be treated.

In the washing tank 2, as shown in FIG. 2, a multi-stage counterflow washing operation, in which the side, from which the belt-shaped steels enter, agrees with the side, from which a concentrated overflow that has been used for the washing is discharged, is carried out. An inside of the washing tank 2 is partitioned into three tanks and a fresh washing water is supplied to the side from which the belt-shaped steels are taken out. That is to say, a portion, from which the belt-shaped steels are taken out, is provided with a nozzle 4 having a caliber of 0.6 mm and said nozzle 4 is supplied with a mixture obtained by mixing water of 3 kg/cm$^2$ sent under pressure from a pump with compressed air of 3 kg/cm$^2$ by means of a pipeline mixer 5. And, water and compressed air are spouted under the condition that they are mixed in a ratio of 1:0.2 to 0.4 to be sprayed onto a surface of the steel materials at an increased hydraulic pressure in spite of their small quantity, whereby being able to improve a washing effect.

Six pieces of nozzle 4 are mounted on a pipe in parallel at regular intervals of 10 cm sideways and end portions of said pipe are adapted to be reciprocated sideways by means of an outside driving eccentric cam. Said washing effect can be improved as compared with the case where a quantity of water supplied is trebled in the conventional fixed nozzles by spraying a stream of water from the nozzles onto the steel materials with reciprocating the pipe sideways at a period of 80 times/-min or more and a stroke of 15 mm by means of an outside vibrating mechanism 9 having this eccentric cam. In addition, in the case where the nozzles are fixed, spray marks are formed on a washed surface and an uneven washing is observed in some cases but these points can be solved by the present invention.

A group of such the movable nozzles is arranged on the rear side and the front side, respectively, of the belt-shaped steel. In addition, the washing effect can be still more improved by installing nozzles at reduced intervals at positions close to a taking-out port of the belt-shaped steel in addition to the nozzles on the rear side and the front side.

It is more effective that these groups of nozzles are installed downward at a position where the belt-shaped steel moves upward.

4) Oily ingredients are carbonized and the resulting carbonaceous ingredients are stuck to the steel materials within the high-temperature salt bath tank 1. And, said carbonaceous ingredients and salts within the salt bath tank 1 are carried in a liquid stored in an intermediate tank of the partitioned washing tank 2 and a tank close to said portion, from which the steel material is taken in, with sticking to the steel material, so that these are accumulated as floating solids. Accordingly, if it is intended that said liquid stored in said tanks is sucked by means of a pump 6 communicating with the respective tanks to spray it onto said surface of the steel material through washing nozzles 7, whereby washing stuck salts, there is the possibility that said washing nozzles 7 are choked to lower the washing effect. So, a filter 8 is disposed on the downstream side of said pump 6 to supply the liquid through said filter 8, whereby an operation can be continuously carried out without choking the washing nozzles 7.

It is advantageous that the washing nozzles 7 have a caliber of 0.8 mm or more.

There is a tendency that the sprayed washing water is heated to be evaporated by a heat of the steel material to gradually reduce a quantity of water stored in the washing tank when the salts stuck to the surface of the steel material carried in are washed to be removed, in the washing tank on the later stage.

As to a measure for such the reduction of the washing water in quantity, a liquid, in which salts are reduced, generated by an operation for recoverying salts contained in the overflow from the washing tank 2 is supplied again in the washing tank 2. Thus, a quantity of the liquid reduced is replenished to insure a stabilized quantity of water, whereby a quantity of the liquid required for the washing operation is maintained.

5) Sodium hydroxide and sodium nitrate are dissolved in the overflow, which is circulated, and in which the salts stuck to the steel material are concentrated, as described in 4), in the same ratio as the salt bath composition. In respect of a relation between their concentrations and the washing effect corresponding to a quantity of salts remaining on the surface of the steel material, their discharging concentrations can be increased with an improvement of the washing effect on the final stage.

Figure 3:
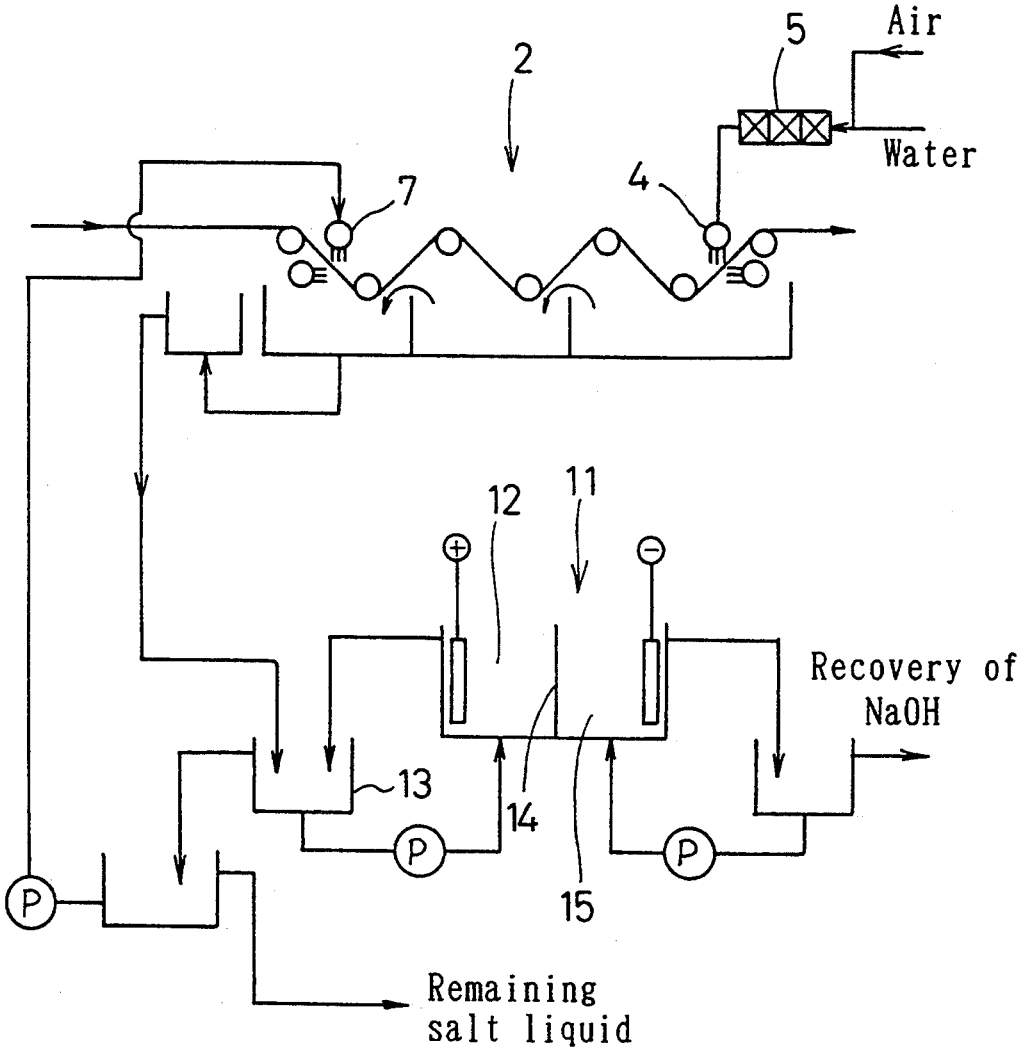
FIG. 3 is a diagram describing a treatment of recoverying dissolved free alkalies from an overflow discharged from said salt-washing tank shown in FIG. 2.

6) In one practically measured example of the concentrations of the soluble salts contained in the overflow discharged from the washing tank 2, the following results were obtained: sodium hydroxide: 1.2N (48 g/l); sodium nitrate: 0.3N (25.5 g/l); $Cr^{6+}$: 5,500 mg/l; Mn:1,800 mg/l; Fe: 1 mg/l; Ni: 4 mg/l. As shown in FIG. 3, this liquid is continuously poured into a circulating tank 13 of an anode chamber 12 of an electrolytic separating tank 11. Thereupon, in a cathode chamber liquid in a cathode chamber 15 partitioned with a cation exchange resin membrane 14 as a partition diaphragm, free sodium hydroxide is electrophoretically separated to be concentrated with the lapse of time. The concentration of the concentrated liquid is related to the condition that the concentration of the anode chamber liquid is maintained. If the concentration of the anode chamber liquid is high and stabilized, it can be maintained at a value higher than the concentration of the cathode chamber liquid.

7) In the anode chamber liquid supplied in said circulating tank 13 as described in 6), $Na^{+}$is electrophoretically separated into said cathode chamber 15 to reduce its concentration when circulated into said electrolytic separating tank 11. This treated liquid, of which concentration has been reduced, is returned to the final nozzles 7 of the washing tank 2 again to be used for washing the steel material again. The concentrated liquid can be returned to said anode chamber 12 again by combining an increase of the concentration due to this removal of stuck salts with the concentration due to the evaporation. In the above described practically measured example, the concentrations described in 6) changed to the following values after 4 hours from the start of circulation: sodium hydroxide: 1.2N (48 g/l); sodium nitrate: 1.5N (127.5 g/l); $Cr^{6+}$: 27,500 mg/l; Mn: 9,000 mg/l. And, it was confirmed that the maintenance of this condition leads to the stabilized operation in the electrolytic separating tank.

8) Although the circulated anode chamber liquid described in 7) is always alkaline, in the case where the concentration of salts is reduced by troubles in the operating system and troubles in the washing operation, the electrophoresis of $Na^{+}$into the cathode chamber 15 advances excessively to acidify the anode chamber 12 in many cases. Under such the condition, the characteristics of the ion exchange membrane are spoiled by troubles, such as an expansion of water within the ion exchange membrane, due to a difference of ionic dissociation speed within said cation exchange membrane 14 according to circumstances. So, it is necessary to provide a pH meter and the maintenance of the concentration of the anode chamber liquid becomes an important matter like the maintenance of the concentration of the cathode chamber liquid in respect of the control of the ion exchange membrane 14.

9) The anionic liquid, from which free sodium hydroxide has been removed, accumulated in the anode chamber 12 as described in 7) is poured into a following pickling tank 3. And, $Cr^{6+}$and $Mn^{5+}$is reduced to $Cr^{3+}$and $Mn^{2+}$, respectively, by a reducing power of iron ions accumulated in said pickling tank 3 so that they may behave as cations in the acidic solution.

In the concrete example, the bath in the acidic bath tank has the following composition: free nitric acid: 0.5N; free hydrofluoric acid: 0.6N; ferrous ion: 0.6N; ferric ion: 0.25N. In addition, a temperature of the bath was set at 50° to 55° C., a volume of the bath being set at 10 $m^3$, and an increasing speed of ferrous ions being set at 100N/hr. And, the above described liquid containing $Cr^{6+}$in a quantity of 27.5 g/l(3.2N) was poured into this bath in a flow rate of 10 l/hr and the concentration of $Cr^{6+}$in the acidic bath was measured after 5 hours. As a result, $Cr^{6+}$was not detected, the concentration of $Cr^{3+}$being 2.81 g/l, and it being confirmed that chromium ions were perfectly reduced with ferrous ions contained in the acidic bath. In addition, stainless steel materials of 300 series according to JIS were immersed in this acidic bath to carry out the treatment of removing scales stuck to the steel material followed by pickling. The surface of the steel material, which has been subjected to the pickling, was observed with the results that said scales remaining on this surface were removed and the allowable finishing condition was achieved. Subsequently, it was found from a comparison of the steel material subjected to this treatment with the steel material subjected to the pickling with a solution of calcium chloride that the former was remarkably improved in corrosion resistance.

Figure 4:
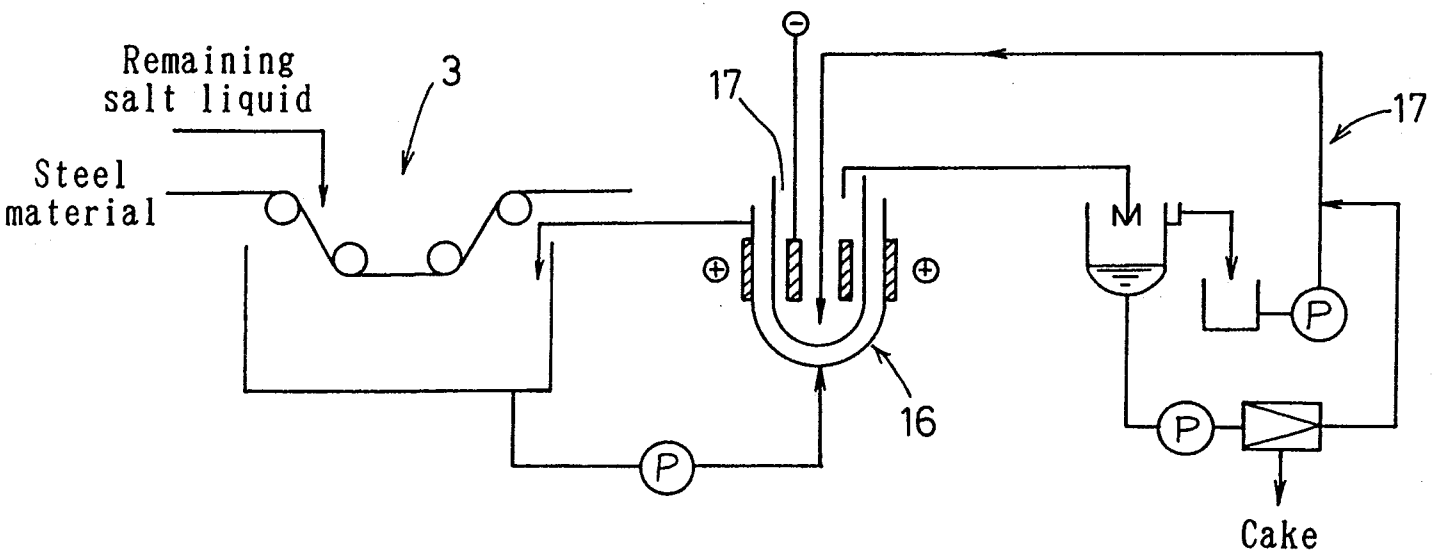
FIG. 4 is a diagram describing an electrolytic separating treatment of metal salts accumulated in an acidic bath tank shown in FIG. 1.

10) The metallic ions, which were carried in the pickling tank described in 9) and reduced, must be removed together with other metallic ions accumulated within said pickling tank 3. As to this treatment method, for example a method shown in FIG. 4 has been disclosed in Japanese Patent Application Laid-Open No. Hei 1-234582. According to this method, cations accumulated in an acidic bath are electrophoretically transferred in a cathode chamber maintaining an alkalinity in an electrolytic separating tank 16 with a cation exchange membrane as a partition diaphragm to be turned into insoluble metal salts, which are sedimented, whereby being able to separate from a system. In addition, referring to FIG. 4, reference numeral 17 designates a cathode chamber liquid-separating tank.

Figure 5:
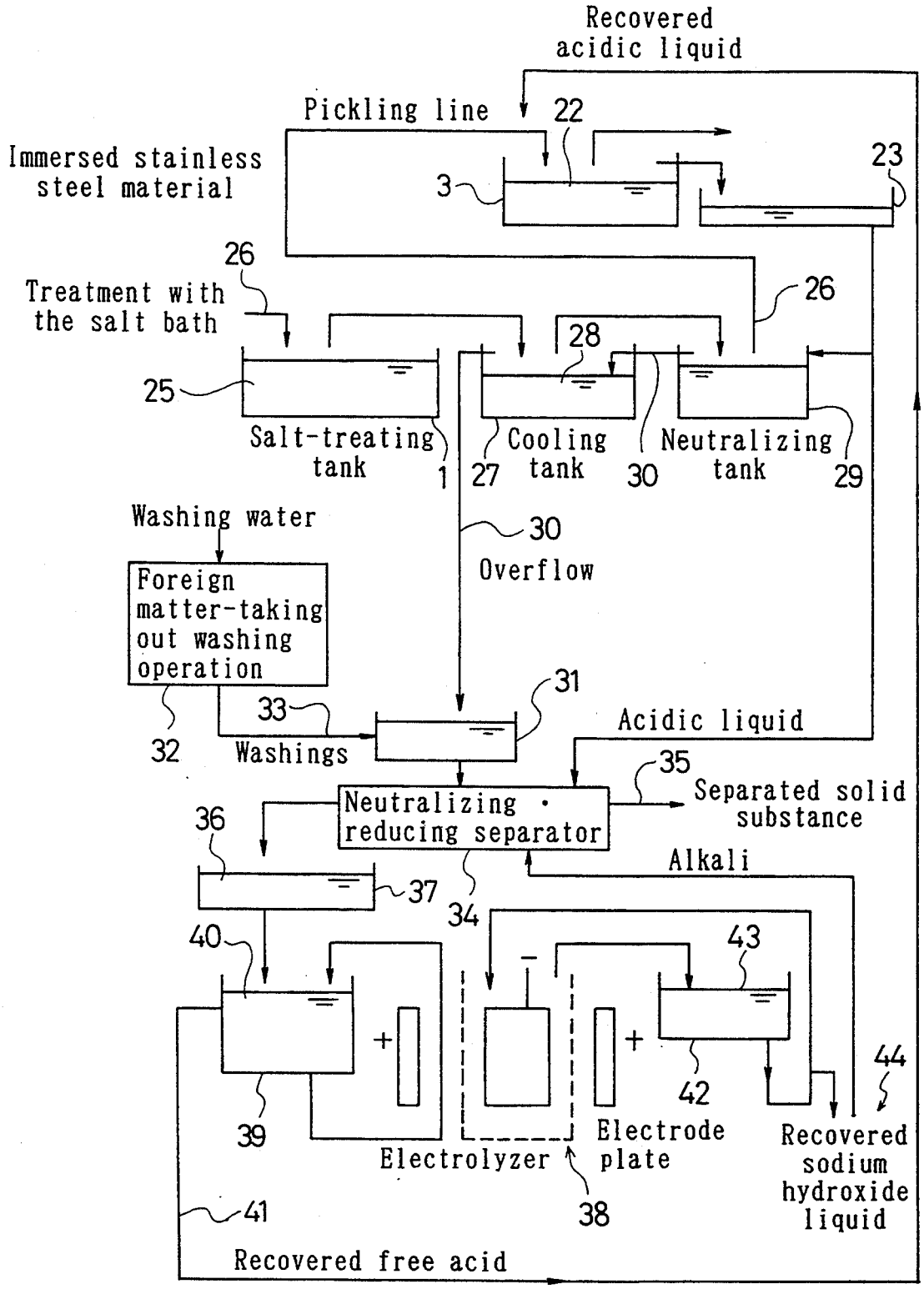
FIG. 5 is a diagram showing a construction of a treatment system in another preferred embodiment of the present invention.

11) One preferred embodiment of a system shown in FIG. 5 will be below described. At first, a nitric acid bath 22 used for the pickling of stainless steels in a pickling tank 3 shown [nitric acid: 2.3N; iron: 0.57N (trivalentiron: 70%)] was stored in a discharged acidic bath tank 23.

12) On the other hand, a composition of salts 25 in a saltbath tank 1 was set at sodium nitrate: sodium hydroxide=7:3 by weight. And, solid powders of said salts 25 were heated to 400° to 600° C. to be turned into a uniform solution. A stainless steel material 26 of SUB 304 according to JIS (Japanese Industrial Standard) was immersed in the salts 25 within said salt bath tank 1. Subsequently, said steel material 26 was immersed in a cooling liquid 28 within a chilling tank 27 to be chilled, whereby scales were made porous so that the descaling in a postpickling treatment might be effectively achieved.

This cooling liquid 28 is changed in composition with the lapse of time but a nitrate radical was contained in a quantity of 50 g/l, sodium salts 34 g/l, $Cr^{6+}$2,000 ppm and hydrolium dispersoids of iron 5,000 ppm. The pH of the cooling liquid 28 was about 13 showing a strong alkalinity.

13) Subsequently, the chilled stainless steel material 26 was immersed in a neutralizing tank 29 where the neutralization was conducted by the use of an acidic bath 2 stored in said discharged acidic bath tank 23.

14) This neutralization was superior as compared with the known neutralization by the use of water and alkalies could be prevented from existing in pores of said scales.

In addition, an overflow 30 from this neutralizing tank 29 was used as a supply water to said chilling tank 27. Said overflow 30 contained a large quantity of soluble sodium nitrate and sodium hydroxide. Also a large quantity of metal hydroxides coexisted.

15) Then, in order to put an operation for recovering reagents contained in the overflows into practice, these liquids 10 were stored in a storage tank 31.

In addition, foreign matters 12, such as insoluble metal hydroxides and quartz sands, sedimented in a bottom portion of the salt bath were taken out to be washed, whereby chromium compounds coexisting with the stuck salts were prevented from scattering and also washings 33 were stored in said storage tank 31.

The liquid stored in the storage tank 31 was at first neutralized with the above described discharged acidic bath and at the same time chromium was reduced by adding activated trivalent iron remaining in the acidic bath under the acidic condition. This state was watched by means of an oxidation-reduction potential-measuring device immersed in a reaction tank. In addition, a temperature of the liquid within said reaction tank was maintained at 40° to 50° C. or more to expect the completion of the treatment.

Alkalies were added to the liquid subjected to the reducing treatment again to insolubilize the dissolved metallic ions and these dispersoids 35 were separated by means of a neutralized • reduced dispersoid separator 34 for removing dispersoids to obtain a clear filtrate 36. Said clear filtrate 36 was stored in a storage tank 37.

16) The stored clear filtrate 36 was supplied to an electrolytic separating tank 38 with an ion exchange membrane as a partition diaphragm. And, a circulating salt solution 40 within a circulating tank 39 on the side of the anode chamber was electrolyzed to recover a recovered free acid liquid 41 and separate and recover sodium hydroxide from a circulating salt liquid 43 within a circulating tank 42 on the side of the cathode chamner.

17) The recovered free acid was 2.5N-nitric acid and it could be used in the acidic bath again.

The alkaline liquid had a concentration of 2.7N and this could be reused also for the neutralization of the liquid subjected to the reducing treatment.

What is claimed is:

1. In a method of treating salt bath liquid used for surface treatment of steel, said surface treatment of steel comprising the steps of:

providing a salt bath furnace containing salt bath liquid, said salt bath liquid containing sodium hydroxide held at a high temperature and also containing oxidative salt such as sodium nitrate;

immersing steel in said salt bath liquid for oxidizing surfaces of said steel so as to form soluble alkaline metallic oxide salt on said surfaces of said steel;

withdrawing said steel, having been heated to a high temperature, from said salt bath liquid;

allowing said steel to pass into a rinsing tank adjacent said salt bath furnace, said rinsing tank being partitioned into a plurality of compartments;

rinsing said steel in said rinsing tank so as to wash off salts sticking to said surfaces of said steel and metallic oxide salt formed on said surfaces of said steel, said rinsing tank being of counter-flow multiwash type such that fresh rinsing water is added to an extreme downstream one of said compartments;

the improvement comprising:

drawing rinsing water out of furthest upstream one of said compartments, said ringing water containing said salts and said metallic oxide salt;

isolating and recovering free alkalis from said salts and said metallic oxide salt contained in said rinsing water drawn out of said furthest upstream one of said compartments;

removing, during said isolation and said recovery, insolubly dispersed phases from said rinsing water drawn out of said furthest upstream one of said compartments;

feeding said rinsing water, from which said insolubly dispersed phases have been removed, to an anode compartment of an electrolyzer, said anode compartment being separated from a cathode compartment by means of a cation exchange membrane having high oxidation resistance, resistance to high temperatures, and high selective permeability for cations;

isolating free sodium hydroxide from said rinsing water and enriching said free sodium hydroxide by subjecting it to ion selective electrophoresis from said anode compartment to said cathode compartment;

allowing said free sodium hydroxide in said rinsing water to decrease to such an extent that an increase in electric resistance results therefrom;

discharging said ringing water, which has been fed to said anode compartment, from said anode compartment through a discharge port; and introducing said rinsing water, which has been discharged from said anode compartment, into said ringing tank so as to make up for a loss of rinsing water therein due to vaporization and control the concentration of salts in rinsing water therein, said concentration being apt to increase because of salts removed from said surfaces of said steel.

2. A method of treating a salt bath liquid as set forth in claim 1, characterized in that the anode chamber composing the electrolytic separating tank for separating free sodium hydroxide is provided with a compulsory circulating device and a watching device for watching the pH and a concentration of neutral salts of a circulating liquid thereoutside to watch whether said circulating liquid is always maintained to be alkaline or not, a maintenance of electrophoretical efficiency characteristics of said ion exchange membrane and an existence of breakage by an information of pH-value, whereby a current efficiency in an electrophoretical operation is maintained at a stabilized high level by regulatedly supplying a concentrated solution of sodium hydroxide in case of emergency, if said concentration of said neutral salts gradually accumulated in the circulating liquid exceeds an appointed value, they being taken out of the system, a recovery of remaining neutral salts, a control of a quantity of oxidizable metal salts to be reduced and insolubilized, a maintenance of the concentration of salts in the anode chamber liquid within an appointed range and a maintenance of a water-content capable of being held in said partition diaphragm being conducted to carry out said electrolytic operation under the stabilized conditions with maintaining a high concentration of sodium hydroxide within the cathode chamber, a control for avoiding a leakage trouble of the anode chamber liquid into the cathode chamber due to a breakage of the partition diaphragm being conducted, the cathode chamber being provided with a compulsory circulating device and an alkali concentration-monitoring device thereoutside, a concentration of free alkalies diffused in the circulating liquid through the partition diaphragm to be accumulated being monitored by means of said alkali concentration-monitoring device, and a concentration of alkalies for maintaining an osmotic pressure of salts balancing with that of the anode chamber liquid being indirectly controlled to carry out a balanced control between said osmotic pressure of salts determined from the concentration of salts in the anode chamber liquid, of which operation is controlled, and an osmotic pressure indicated by a concentration of salts on the side of the cathode chamber being conducted.

3. A method of treating a salt bath liquid as set forth in claim 1, characterized in that a liquid circulated between the washing tank and the electrolytic separating tank and containing soluble metal oxides is supplied to the electrolytic separating tank, said treating liquid being concentrated so as to contain acids of a quantity required for making the liquid acidic by diffusedly electrophoretically transferring almost all of free sodium hydroxide remaining in the anode chamber liquid in the electrolytic separating tank into the cathode chamber, the concentrated treating liquid being poured into the bath, of which concentration is controlled, within the acidic bath tank in the same one treating line, soluble metal salts remaining in the poured liquid being turned into the reduced metal salts having a less valence by a reducing power exhibited when ferrous ions dissolved in the acidic bath liquid are oxidized to ferric ions, and the metal salts accumulated in the acidic bath tank being electrophoretically transferred into the cathode chamber of the electrolytic separating tank to be turned into insoluble metal hydroxides which are discharged out of the system and at the same time anions (nitrate radicals) and cations ($Na+$) bonded to said nitrate radicals being recovered in the form of free salts, respectively.

* * * * *